US005960944A

United States Patent [19]

Plocher

[11] Patent Number: 5,960,944

[45] Date of Patent: Oct. 5, 1999

[54] CONTAINER FOR STORING A PLURALITY OF CHECK CARDS

[75] Inventor: Bernd Plocher, Rottenburg-Seebronn, Germany

[73] Assignee: fischerwerke Artur Fischer GmbH & Co. KG, Waldachtal, Germany

[21] Appl. No.: 08/900,594

[22] Filed: Jul. 25, 1997

[30] Foreign Application Priority Data

Aug. 9, 1996 [DE] Germany ..... 196 32 215

[51] Int. Cl.[6] ..... B65D 83/00

[52] U.S. Cl. ..... 206/39.4; 206/449; 221/232

[58] Field of Search ..... 206/39, 39.4, 449, 206/555, 556; 221/232

[56] References Cited

U.S. PATENT DOCUMENTS

| | | | |
|---|---|---|---|
| 4,760,502 | 7/1988 | Ackeret | 206/308.1 |
| 4,792,058 | 12/1988 | Parker | 206/39.4 |
| 4,852,727 | 8/1989 | Oberle | 206/39.4 |
| 5,125,505 | 6/1992 | Kurosaki | 206/449 |
| 5,791,461 | 8/1998 | Tsuge | 206/39.4 |

FOREIGN PATENT DOCUMENTS

| | | |
|---|---|---|
| 3544054A1 | 6/1987 | Germany . |
| 9000892 U | 6/1990 | Germany . |
| 9406483 U | 8/1994 | Germany . |

*Primary Examiner*—Jim Foster
*Attorney, Agent, or Firm*—MIchael J. Striker

[57] ABSTRACT

The container (10) has a plurality of slots (14) for the insertion of check or credit cards to be held by it. So that each card can be removed individually, rockers (22) are pivotably mounted at a rear end face (20) of the container (10), are joined to one another integrally by way of resilient connectors (36) so as to be movable relative to one another and are joined integrally with push rods (38) extending to a front face (16) of the container by way of a strip hinge (40). By pressing on push buttons formed on the push rods (38) at the front face, the rockers (22) pivot and push the card in question out of the container (10). The invention has the advantage that the rockers (22) can be produced integrally with one another and with their push rods (38) in the form of an injection-molded component.

11 Claims, 3 Drawing Sheets

CONTAINER FOR STORING A PLURALITY OF CHECK CARDS

BACKGROUND OF THE INVENTION

The present invention relates to a device for storing a plurality of check cards, credit cards or the like, having a container provided with slots for insertion of cards through a front face of the container.

For the sake of simplicity in the following below the cards are referred to only as check cards.

The device has a container having slots that are open at a front face of the container so that the check cards can be pushed into the container in their lengthwise or widthwise direction to lie completely within the container. The slots form storage compartments for the check cards in which the check cards can be stored spaced apart from one another in the manner of a stack.

SUMMARY OF THE INVENTION

It is an object of the present invention to provide a device of the above-described type for storing check cards, credit cards or the like which allows any desired check card to be removed from the container without difficulty and which is simple and economical to manufacture and assemble.

According to the invention, the device comprises pivotable rockers pivotally mounted in the container which can be pivoted from an outside face of the container and, on being pivoted, press with one rocker arm against a rear edge of a card that has been inserted into a slot and push that card forwards out of the container until it projects beyond the front face of the container and beyond the other inserted check cards, so that it can easily be grasped and withdrawn from the container. The rockers, which are preferably in the form of a plastic injection-molded component, are joined to one another integrally so as to be movable relative to one another. In its simplest form, therefore, the device consists merely of two parts, namely the container having the slots and the rockers integral with one another and located pivotably in the container.

Preferably the rockers are arranged to pivot by way of push rods which engage another rocker arm and extend as far as the front face of the container. At the front face of the container the push rods can be constructed in the form of push buttons that project beyond the front face of the container. When the push buttons are pushed into the container; the rocker pivots and thus pushes the check card in question out of the container. The push rods are joined to the other rocker arm pivotably and integrally by way of a strip hinge. The strip hinge is a short, approximately linear portion which forms a pivot joint joining the push rod integrally with the rocker. In this way the push rods are integral with the rockers and the latter are integral with one another and therefore they form a single component produced especially from plastic material by injection-molding. In addition to allowing the rapid production of all the rockers and push rods together in a single operation, this has the advantage that the connected rockers with the push rods can be pivotably mounted in the container in a single mounting step.

For the purposes of pivotal mounting, in one embodiment of the invention the rockers have pivot elements which are located in recesses that are open to a rear face of the container. Those recesses are closed by the attachment of a container rear wall so that the pivot elements are pivotably mounted in the container.

Preferably the rockers or the push rods have integral spring elements, for example in the form of injection-molded resilient spring tongues, which engage a counter surface of the container or the container rear wall and press the rockers into their rest position.

In order that the push rods can be actuated individually without difficulty, without an adjacent push rod being displaced unintentionally at the same time, the push rods are arranged at the sides of the slots and on alternate sides of the container. As a result, on the front face of the container, where they are actuated by being pressed in, they are spaced two slots apart from one another.

For the purpose of holding the inserted check cards in the container, clamping elements are provided in the slots. The clamping elements are preferably constructed in the form of clips integral with the rear wall of the container and projecting into the slots.

In a preferred embodiment of the invention the container has connection means with which the container can be releasably connected to a further container to form a stack. As a result, it is possible to combine any number of containers in order to provide space for any desired number of check cards. It is also possible to use the connection means for the releasable mounting of the container on a corresponding holding device provided, for example, in the glove compartment of a motor vehicle. The container can thus be mounted in the motor vehicle and can be removed at any time in order that the check cards do not have to be left behind in the motor vehicle.

The connection means are preferably constructed in the form of snap connection means. They can be pushed releasably onto the container so that they can be attached to the container when required.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
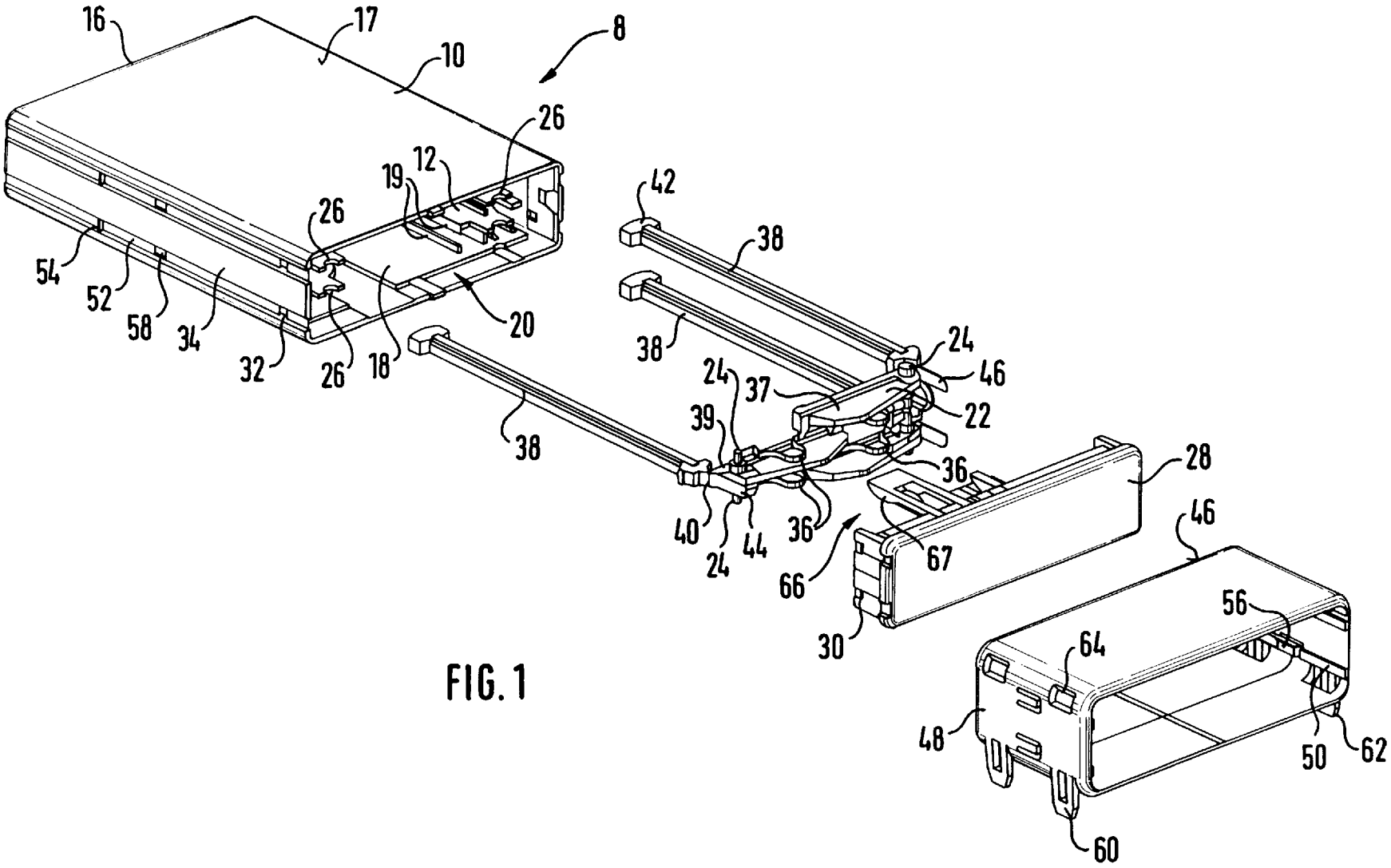
FIG. 1 is a perspective exploded view of a device according to the invention.
Figure 2:
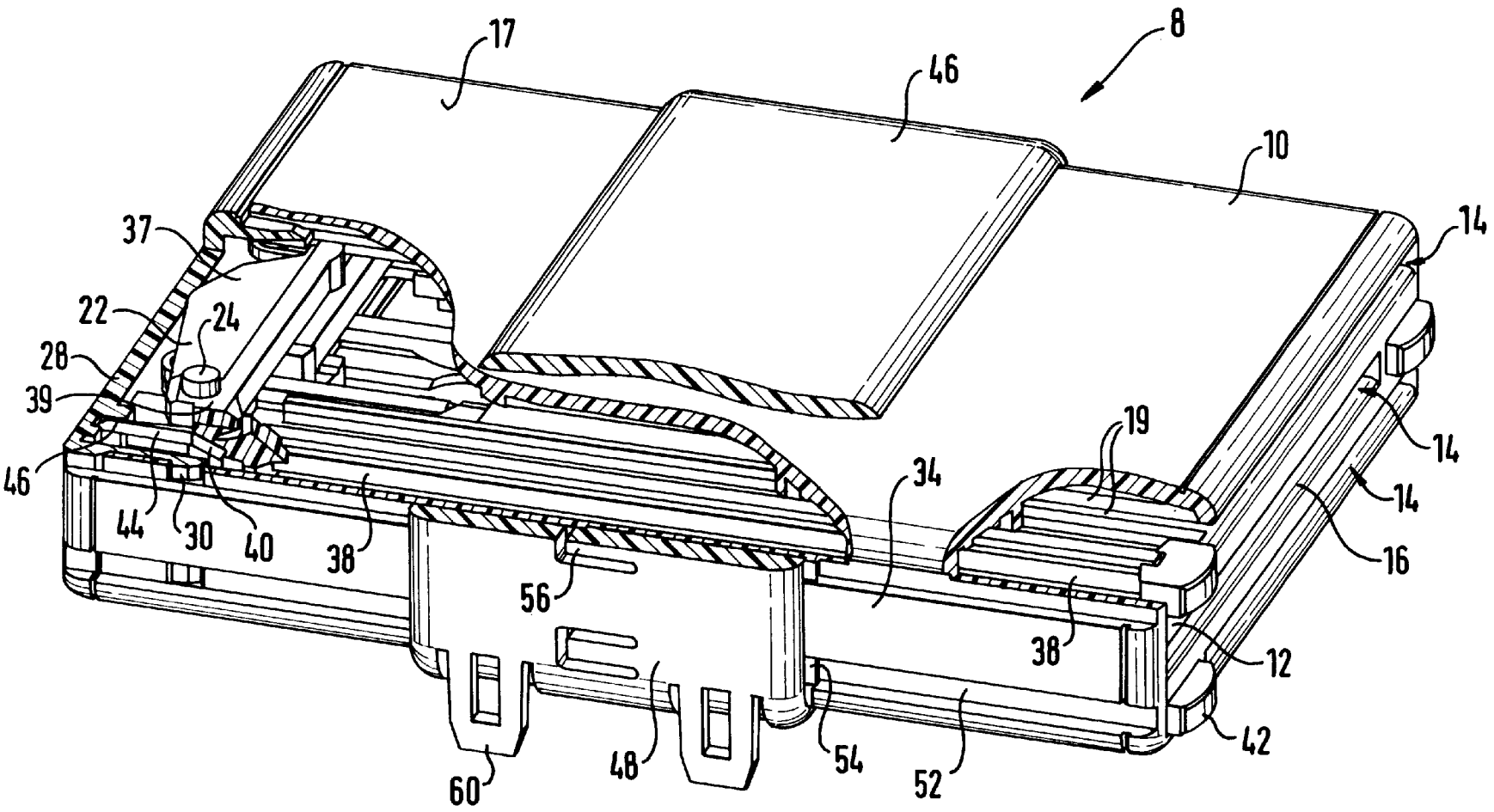
FIG. 2 is a perspective view of the assembled device from FIG. 1 with portions cut away.

The device 8 according to the invention shown in FIGS. 1 and 2 has a container 10 for storing check cards, credit cards or the like. The container 10 is a plastics injection-molded component having a low rectangular cross-section. It is divided into three slots 14 by two partitions 12 integral with the container 10. The slots 14, which serve as storage compartments for the check cards, are open at a front face 16 of the container 10 for the insertion of check cards (not shown). On the partitions 12 and on the inner face of a container top face 17 and of a container base 18, integrally injection-molded slide ribs 19 are provided which extend in the longitudinal direction. The slide ribs are so arranged that an inserted check card rests on the slide ribs 18 outside of the region carrying its magnetic strip, memory chip or the like, in order that damage to the magnetic strip, memory chip or the like is avoided when the check card is being pushed into or removed from the container 10.

A rear face 20 of the container 10 is open. Three rockers 22 are inserted into the container 10 through the open rear face 20. The rockers 22 have pivot elements 24 projecting from each side which are located in complementarily shaped recesses 26 open to the rear end face 20 of the container 10 in the lateral regions of the partitions 12 and of the container top face 17 and of the container base 18. These recesses 26 are closed by a container rear wall 28 which is mounted on the open rear end face 20 of the container 10 and closes that face.

In that way, the rockers 22 are pivotably mounted in the recesses 26. The rockers 22 are arranged in the rear region of the slots 14 transverse to the insertion direction of the check cards. The container rear wall 28 is affixed to the container 10 by lateral locking lugs 30 which engage in openings 32 in the side walls 34 of the container 10. The container rear wall 28 is a plastics injection-molded component.

The rockers 22 are mounted alternately on different sides of the container 10. They are joined integrally to one another by resilient connectors 36 so as to be movable relative to one another. The connectors 36 each extend in a curving path from one pivot element 24 of a rocker 22 to a rocker arm 37, facing the pivot element 24, of an adjacent rocker 22, which rocker arm 37 ends approximately in the center of the slot 14 in question.

Push rods 38 are joined to a second or another rocker arm 39 pivotably and integrally with the rockers 22 by way of a strip hinge 40. The strip hinge 40 is a thin linear portion extending parallel to the pivot elements 24, which, on account of its resilience, joins the push rods 38 pivotably and integrally with the second ends of the rocker arms 39.

The push rods 38 extend at the sides of the slots 14 to the front face 16 of the container 10, where they are formed integrally as push buttons 42 that project out of the front face 16 of the container 10. By pushing the push rods 38 into the container 10 by pushing the push buttons 42, that is to say in the direction towards the container rear wall 28, the rockers 22 pivot individually. On so doing, the rocker arms 37 on the side of the pivot elements 24 remote from the push rods 38 pivot in the direction towards the front face 16 of the container 10. In the central region, those rocker arms 37 press against a rear edge of a check card inserted into the slot 14 in question and push that check card out of the front face 16 of the container 10 until it can easily be grasped and removed.

The three rockers 22 are integral with one another by way of the connectors 36 and integral with their respective push rods 38 by way of the strip hinges 40. The three push rods 38 and the three rockers 22 are therefore produced integrally from plastics as an injection-molded component. They can be molded in the U-shape shown, in which the push rods 38 form the arms and the rockers 22 form the cross-piece of the U. Preferably they are molded in the form of an elongated component in which the push rods 38 form a continuation of the rockers 22 on both sides in an approximately straight line. Prior to mounting, the push rods 38 are pivoted about the strip hinges 40 through about 900 into the U-position shown, and the component forming the rockers 22 and the push rods 38 is inserted into the container 10 through the open rear face 20. Then the container rear wall 28 is pushed onto the rear end face 20 of the container 10 until the locking lugs 30 lock into place. The rear face 20 of the container 10 is thereby closed and the pivot elements 24 are held pivotably in the recesses 26 of the container 10.

Resilient spring tongues 44 are injection-molded integrally with the other or second rocker arms 39 having the strip hinge 40. Those tongues are in contact with counter surfaces of the container rear wall 48 and press the rockers 22 into a rest position in which a check card can be pushed into the container 10 to lie fully within the latter. The spring tongues 44 at the same time press, by way of the strip hinge 40, the push rods 38 in the direction of the front face 16 of the container 10, so that the push buttons 42 thereof project out of the front face 16. The pressing in of the push rods 38 and the pivoting of the rockers 22 in order to push the check cards out of the container 10 therefore take place against the spring force of the spring tongues 44.

For the purpose of holding the check cards that have been inserted into the slots 14 in the container 10, the container 10 has clips 66. The clips consist of pairs of spring tongues 67 which are integral with the container rear wall 28. The clips 66 project into a rear region of the slots 14. On being pushed in, a check card passes between the spring tongues 67 of the clips 66 which press against an upper and a lower face of the check card and clamp the check card between them.

In the longitudinal direction, a connection means 46 produced in the form of a plastic injection-molded component is pushed onto the container 10. The connection means is constructed in the form of a rectangular band resting on the container 10 in the manner of a revenue band. It has on inner sides of its side walls 48 two slide springs 50 extending in the longitudinal direction which are guided in longitudinal grooves 52 in the side walls 34 of the container 10. Because the connection means 46 is guided longitudinally on the container 10 with the slide springs 50 engaging in the longitudinal grooves 52, it is not necessary for the connection means 46 to surround the container 10 completely. It could also be constructed in the form of a clip open at the container top face 17 or the container base 18.

The longitudinal grooves 52 in the side walls 34 of the container 10 are interrupted by cross-ribs 54 which form a stop for the slide springs 50 of the connection means 46. By pushing the connection means 46 from the rear face 16 onto the container 10 until it strikes the cross-ribs 54, the connection means 46 is positioned approximately in the center of the container 10. In that position, snap lugs 56 on the inner sides of the side walls 48 of the connection means 46 engage in depressions 58 in the longitudinal grooves 52 of the side walls 34 of the container 10 and thereby fix the connection means 46 releasably in the intended position in the center of the container 10.

Towards the top or towards the bottom, depending upon the position in which the connection means 46 is pushed onto the container 10, two resilient tongues 60 project on each side of the connection means 46. The spring tongues 60 have snap lugs 62 on their free ends.

Figure 3:
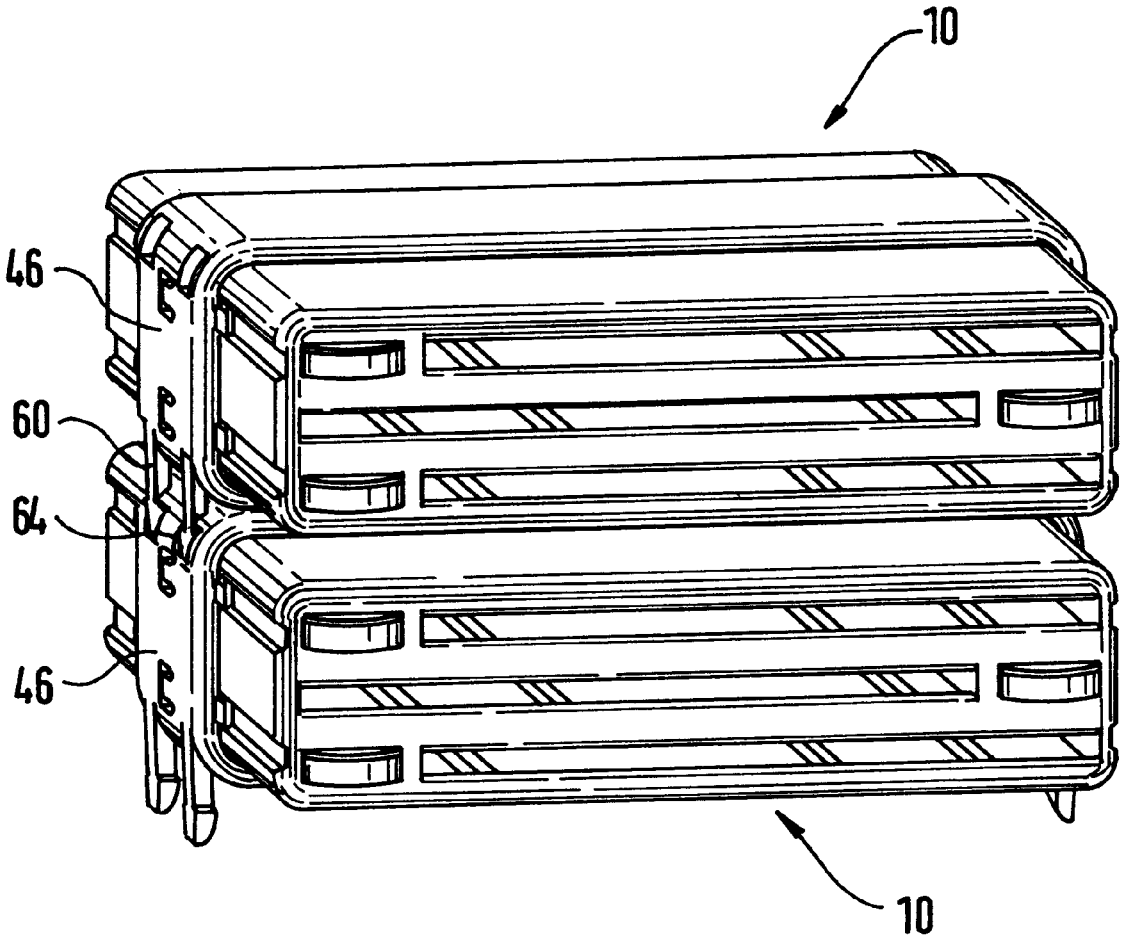
FIG. 3 is a perspective view of two devices according to FIG. 1 releasably connected to one another to form a stack.

At the bottom or at the top, respectively, the connection means 46 has on each of its sides two snap recesses 64 complementary to the spring tongues 60 having the snap lugs 62, which recesses are provided for snapping in the snap lugs 62 of the spring tongues 60 of a further connection means 46. In this way it is possible for any number of containers 10 to be releasably connected together to form a stack (FIG. 3). Furthermore, the containers 10 can be mounted releasably on a holding device (not shown), for example in the glove compartment of a motor vehicle, having snap recesses corresponding to the snap recesses 64.

The disclosure in German Patent Application 196 32 215.4 of Aug. 9, 1996 is incorporated here by reference. This German Patent Application describes the invention described hereinabove and claimed in the claims appended herein in below and provides the basis for a claim of priority for the instant invention under 35 U.S.C. 119.

While the invention has been illustrated and described as embodied in a container for storing a plurality of check cards, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A device for storing a plurality of cards including check cards and credit cards, said device comprising a container (10) having a front face (16) and provided with a plurality of slots (14) for insertion of said cards through said front face into the container, and a plurality of pivotable rockers (22) pivotably mounted in the container (10) and connected with each other integrally so as to be movable relative to each other, each of said rockers (22) including one rocker arm (37) positioned so as to press against a rear edge of one of said cards inserted into the container (10) when said rocker arm (37) is pivoted and to thus push said card out of the container (10) so that said card projects from the front face (16) of the container (10).

2. The device according to claim 1, wherein each of said rockers (22) has a push rod (38) and another rocker arm (39) pivotably and integrally joined to the push rod (38) by means of a strip hinge (40), and said push rods extend as far as the front face (16) of the container (10).

3. The device according to claim 1, wherein the rockers (22) have pivot elements (24) pivotably mounted in respective recesses (26) at a rear face (20) of the container (10), and said recesses are closed by a container rear wall (28) closing the rear face (20) of the container (10).

4. The device according to claim 1, wherein the rockers (22) have integral spring elements (44) urging said rockers (22) into position.

5. The device according to claim 2, wherein the push rods (38) have integral spring elements (44) urging the push rods (38) into a rest position.

6. The device according to claim 2, wherein the push rods (38) are arranged at alternate sides of the container (10).

7. The device according to claim 1, wherein the container (10) has clamping elements which hold said cards inserted into the slots (14) of the container (10).

8. The device according to claim 7, wherein the clamping elements are clips (66) integral with a container rear wall (28) of the container (10), said clips project into the slots (14) for said cards, and the container rear wall (28) is mounted on a rear face (20) of the container (10).

9. The device according to claim 1, wherein the container (10) has connection means (46) for releasably connecting the container (10) to a further container or to a holding device.

10. The device according to claim 9, wherein the connection means (46) is a snap connection means.

11. The device according to claim 9, further comprising means for pushing said connection means (46) onto the container (10).

* * * * *